US007293955B2

(12) United States Patent
Lawlor et al.

(10) Patent No.: US 7,293,955 B2
(45) **Date of Patent: *Nov. 13, 2007**

(54) SUPERSONIC GAS COMPRESSOR

(75) Inventors: Shawn P. Lawlor, Bellevue, WA (US); Mark A. Novaresi, San Diego, CA (US); Charles C. Cornelius, Kirkland, WA (US)

(73) Assignee: Ramgen Power Systrms, Inc., Bellevue, WA (US)

( * ) Notice: Subject to any disclaimer, the term of this patent is extended or adjusted under 35 U.S.C. 154(b) by 172 days.

This patent is subject to a terminal disclaimer.

(21) Appl. No.: 11/087,336

(22) Filed: Mar. 23, 2005

(65) Prior Publication Data

US 2005/0271500 A1 Dec. 8, 2005

Related U.S. Application Data

(63) Continuation-in-part of application No. 10/672,719, filed on Sep. 25, 2003, now abandoned.

(60) Provisional application No. 60/414,793, filed on Sep. 26, 2002.

(51) Int. Cl.
*F01D 1/34* (2006.01)

(52) U.S. Cl. ..... 415/90; 415/73; 415/99; 415/102; 415/144; 415/151; 415/191; 416/199; 416/198

(58) Field of Classification Search ..... 415/90, 415/73, 144, 99, 102, 191, 151; 416/199, 416/198

See application file for complete search history.

(56) References Cited

U.S. PATENT DOCUMENTS 2,435,236 A 2/1948 Redding
2,570,081 A 10/1951 Szczeniowski
2,579,049 A 12/1951 Price (Continued)

FOREIGN PATENT DOCUMENTS

EP 0375198 A2 6/1990

(Continued)

OTHER PUBLICATIONS

English Translation of JP Hei 11-351191A.

(Continued)

*Primary Examiner*—Ninh H. Nguyen
(74) *Attorney, Agent, or Firm*—R. Reams Goodloe, Jr.

(57) ABSTRACT

A gas compressor based on the use of a driven rotor having a compression ramp traveling at a local supersonic inlet velocity (based on the combination of inlet gas velocity and tangential speed of the ramp) which compresses inlet gas against a stationary sidewall. In using this method to compress inlet gas, the supersonic compressor efficiently achieves high compression ratios while utilizing a compact, stabilized gasdynamic flow path. Operated at supersonic speeds, the inlet stabilizes an oblique/normal shock system in the gasdyanamic flow path formed between the rim of the rotor, the strakes, and a stationary external housing. Part load efficiency is enhanced by the use of a pre-swirl compressor, and using a bypass stream to bleed a portion of the intermediate pressure gas after passing through the pre-swirl compressor back to the inlet of the pre-swirl compressor. Inlet guide vanes to the compression ramp enhance overall efficiency.

69 Claims, 7 Drawing Sheets

U.S. PATENT DOCUMENTS 2,623,688 A 12/1952 Davidson
2,628,768 A 2/1953 Kantrowitz
2,648,493 A 8/1953 Stalker
2,659,528 A 11/1953 Price
2,689,681 A 9/1954 Sabatiuk
2,710,136 A 6/1955 De Ganahl et al.
2,721,693 A 10/1955 Fabri et al.
2,749,027 A 6/1956 Stalker
2,763,426 A 9/1956 Erwin
2,792,983 A 5/1957 Stalker
2,797,858 A 7/1957 Von Der Nuell
2,805,818 A 9/1957 Ferri
2,806,645 A 9/1957 Stalker
2,819,837 A 1/1958 Loeb
2,830,753 A 4/1958 Stalker
2,834,573 A 5/1958 Stalker
2,839,239 A 6/1958 Stalker
2,841,325 A 7/1958 Weise
2,853,227 A 9/1958 Beardsley
2,918,254 A 12/1959 Hausammann
2,934,259 A 4/1960 Hausmann
2,935,246 A 5/1960 Roy
2,943,839 A 7/1960 Birmann
2,944,786 A 7/1960 Angell et al.
2,947,139 A 8/1960 Hausmann
2,949,224 A 8/1960 Pavlecka
2,953,295 A 9/1960 Stalker
2,955,747 A 10/1960 Schwaar
2,956,732 A 10/1960 Stalker
2,966,028 A 12/1960 Johnson et al.
2,967,013 A 1/1961 Dallenbach et al.
2,970,750 A 2/1961 Swearingen
2,974,857 A 3/1961 Schwaar
2,974,858 A 3/1961 Koffel et al.
2,974,927 A 3/1961 Johnson
2,989,843 A 6/1961 Ferri
2,991,929 A 7/1961 Stalker
3,001,364 A 9/1961 Woodworth
3,010,642 A 11/1961 Dickmann et al.
3,054,255 A 9/1962 Stratford
3,088,279 A 5/1963 Diedrich
3,118,277 A * 1/1964 Wormser ..... 60/39.35
3,145,915 A 8/1964 Marchal et al.
3,156,407 A 11/1964 Bourquard
3,184,152 A 5/1965 Bourquard
3,269,120 A 8/1966 Sabatiuk
3,356,289 A 12/1967 Plotkowiak
3,422,625 A 1/1969 Harris
3,442,441 A 5/1969 Dettmering
3,447,740 A 6/1969 Fabri et al.
3,524,458 A 8/1970 Goldsmith
3,541,790 A 11/1970 Kellett
3,588,270 A 6/1971 Boelcs
3,658,437 A 4/1972 Soo
3,692,425 A 9/1972 Erwin
3,719,426 A 3/1973 Friberg
3,724,968 A 4/1973 Friberg et al.
3,765,792 A 10/1973 Exley
3,771,925 A 11/1973 Friberg et al.
3,824,029 A 7/1974 Fabri et al.
3,873,229 A 3/1975 Mikolajczak et al.
3,904,308 A 9/1975 Ribaud
3,904,312 A 9/1975 Exley
3,917,434 A 11/1975 Bandukwalla
3,956,887 A 5/1976 MacDonald
3,971,209 A 7/1976 de Chair
3,989,406 A 11/1976 Bliss
3,993,414 A 11/1976 Meauze et al.
RE29,128 E 2/1977 Sohre
4,006,997 A 2/1977 Friberg et al.
4,011,028 A 3/1977 Borsuk
4,012,165 A 3/1977 Kraig
4,012,166 A 3/1977 Kaesser et al.
4,070,824 A 1/1978 Traut
4,123,196 A 10/1978 Prince, Jr. et al.
4,156,344 A 5/1979 Cuthbertson et al.
4,199,296 A 4/1980 de Chair
4,212,585 A 7/1980 Swarden et al.
4,241,576 A 12/1980 Gertz
RE30,720 E 8/1981 Sohre
4,408,957 A 10/1983 Kurzrock et al.
4,445,816 A 5/1984 Ribaud et al.
4,479,755 A 10/1984 Skoe
4,678,398 A 7/1987 Dodge et al.
5,123,811 A 6/1992 Kuroiwa
5,161,945 A * 11/1992 Clevenger et al. ..... 415/177
5,277,549 A 1/1994 Chen et al.
5,286,162 A 2/1994 Veres
5,445,496 A 8/1995 Brasz
5,554,000 A 9/1996 Katoh et al.
5,676,522 A 10/1997 Pommel et al.
5,704,764 A 1/1998 Chupp et al.
5,709,076 A 1/1998 Lawlor
5,782,079 A 7/1998 Chiang et al.
6,017,186 A 1/2000 Hoeger et al.
6,263,660 B1 7/2001 Lawlor
6,279,309 B1 8/2001 Lawlor et al.
6,298,653 B1 10/2001 Lawlor
6,334,299 B1 1/2002 Lawlor
6,434,924 B1 8/2002 Lawlor
6,446,425 B1 9/2002 Lawlor
6,488,469 B1 12/2002 Youssef et al.
6,507,125 B1 1/2003 Choi
RE38,040 E 3/2003 Spear et al.
6,682,301 B2 1/2004 Kuhne
6,694,743 B2 2/2004 Lawlor et al.
2002/0073714 A1 6/2002 Yim et al.

FOREIGN PATENT DOCUMENTS

FR 863484 1/1941
GB 648647 1/1951
JP HEI 11-351191 A 12/1999
JP 2001-295775 A 10/2001

OTHER PUBLICATIONS

English Translation of JP2001-295775A.
Patent Abstracts of Japan, Application No. 10155771, Application Date: Jun. 4, 1998. Applicant Mayekawa Mfg. Co.; Inventors: Yamamoto Makoto et al, "High Pressure Generating Method And Compressor Using This Method". Date of Application Publication: Dec. 21, 1999. (3 pages).
Patent Abstracts of Japan, Application No. 2001104506, Application Date: Jun. 4, 1998. Applicant Mayekawa Mfg. Co.; Inventors: Yamamoto Makoto et al, "High Pressure Compressor". Date of Application Publication: Oct. 26, 2001. (2 pages).

* cited by examiner

SUPERSONIC GAS COMPRESSOR

RELATED PATENT APPLICATIONS

This application is a Continuation-In-Part of prior U.S. patent application Ser. No. 10/672,719, filed Sep. 25, 2003 now abandoned, entitled SUPERSONIC GAS COMPRESSOR, (assigned of record on Apr. 22, 2004 and May 3, 2004 and recorded on May 11, 2004 at Reel/Frame 015313/0771 to Ramgen Power Systems, Inc. of Bellevue, Wash.), which utility application claimed priority from prior U.S. Provisional Patent Application Ser. No. 60/414,793, filed on Sep. 26, 2002, the disclosures of which are incorporated herein in their entirety by this reference, including the specification, drawings, and claims of each application.

STATEMENT OF GOVERNMENT INTEREST

This invention was made with United States Government support under Contract No. DE-FC026-00NT40915 awarded by the United States Department of Energy. The U.S. Government has certain rights in the invention.

COPYRIGHT RIGHTS IN THE DRAWING

A portion of the disclosure of this patent document contains material that is subject to copyright protection. The applicant no objection to the facsimile reproduction by anyone of the patent document or the patent disclosure, as it appears in the Patent and Trademark Office patent file or records, but otherwise reserves all copyright rights whatsoever.

TECHNICAL FIELD

This invention relates to a high efficiency, novel gas compressor in which saving of power as well as improved compression performance and durability are attained by the use of supersonic shock compression of process gas. Compressors of that character are particularly useful for compression of air, refrigerants, steam, and hydrocarbons.

BACKGROUND

A continuing demand exists for simple, highly efficient and inexpensive gas compressors as may be useful in a wide variety of gas compression applications. This is because many gas compression applications could substantially benefit from incorporating a compressor that offers a significant efficiency improvement over currently utilized designs. In view of increased energy costs, particularly for both for electricity and for natural gas, it would be desirable to attain significant cost reduction in gas compression. Importantly, it would be quite advantageous to provide a novel compressor which provided improvements (1) with respect to operating energy costs, (2) with respect to reduced first cost for the equipment, and (3) with respect to reduced maintenance costs. Fundamentally, particularly from the point of view of reducing long term energy costs, this would be most effectively accomplished by attaining gas compression at a higher overall cycle efficiency than is currently known or practiced industrially. Thus, the important advantages of a new gas compressor design providing the desirable features of improved efficiency, particularly at part load operation, can be readily appreciated.

SUMMARY

We have now invented a gas compressor based on the use of a driven rotor having a compression ramp traveling at a local supersonic inlet velocity (based on the combination of inlet gas velocity and tangential speed of the ramp) which compresses inlet gas against a stationary sidewall. In using this method to compress inlet gas, the supersonic compressor efficiently achieves high compression ratios while utilizing a compact, stabilized gasdynamic flow path. Operated at supersonic speeds, the inlet stabilizes an oblique/normal shock system in the gasdyanamic flow path formed between the rim of the rotor, the strakes, and a stationary external housing.

Efficiency can be further enhanced by using a pre-swirl inlet compressor wheel prior to entry of gas to the supersonic compression ramp. Such pre-swirl inlet compression wheel (a) provides an initial pressure boost over incoming (often ambient atmospheric pressure, in the case of air compression) gas pressure, and (b) energizes inlet gas in a counter swirling direction to impart an initial velocity vector on the inlet gas so as to increase apparent mach number when the inlet gas is ingested by the supersonic compression ramp.

By use of a gas bypass valve arrangement, the low pressure compressed gas output (i.e., mass flow rate) from the pre-swirl compressor unit can be turned down as necessary while maintaining high rotating velocity (utilizing a fixed shaft speed, i.e., constant rotating velocity where necessary or desirable), such as is necessary when utilizing constant speed compressor drive apparatus, while maintaining minimal output loads. Moreover, this technique allows maintenance of relatively high efficiency compression with good turn down capability, since the supersonic compressor wheel continues to operate at an efficient high speed condition.

The structural and functional elements incorporated into this novel compressor design overcomes significant and serious problems which have plagued earlier attempts at supersonic compression of gases in industrial applications. First, at the Mach numbers at which my device operates (in the range from about Mach 1.5 or lower to about Mach 4.0), the design minimizes aerodynamic drag. This is accomplished by both careful design of the shock geometry, as related to the rotating compression ramp and the stationary wall, as well as by effective use of a boundary layer control and drag reduction technique. Thus, the design minimizes parasitic losses to the compression cycle due to the drag resulting simply from rotational movement of the rotor. This is important commercially because it enables a gas compressor to avoid large parasitic losses that undesirably consume energy and reduce overall efficiency.

Also, more fundamentally, this compressor design can develop high compression ratios with very few aerodynamic leading edges. The individual leading edges of the thousands of rotor and stator blades in a conventional high pressure ratio compressor, especially as utilized in the gas turbine industry, contribute to the vast majority of the viscous drag loss of such systems. However, in that the design of the novel gas compressor disclosed herein utilizes, in one embodiment, less than five individual aerodynamic leading edges subjected to stagnation pressure, viscous losses are significantly reduced, compared to conventional gas compression units heretofore known or utilized. As a result, the novel compressor disclosed and claimed herein has the potential to be up to ten percentage points more efficient than a conventional gas turbine compressor, when compared at competing compression ratios in the range from about ten to one (10:1) to about thirty to one (30:1).

Second, the selection of materials and the mechanical design of rotating components avoids use of excessive quantities or weights of materials (a vast improvement over large rotating mass bladed centrifugal compressor designs). Yet, the design provides the necessary strength, particularly tensile strength where needed in the rotor, commensurate with the centrifugal forces acting on the extremely high speed rotating components.

Third, the design provides for effective mechanical separation of the low pressure incoming gas from the exiting high pressure gases, while allowing gas compression operation along a circumferential pathway.

This novel design enables the use of lightweight components in the gas compression pathway. To solve the above mentioned problems, we have now developed compressor design(s) which overcome the problems inherent in the heretofore known apparatus and methods known to me which have been proposed for the application of supersonic gas compression in industrial applications. Of primary importance, we have now developed a low drag rotor which has one or more gas compression ramps mounted at the distal edge thereof. A number N of peripherally, preferably partially helically extending strakes S partition the entering gas flow sequentially to the inlet to a first one of the one or more gas compression ramps, and then to a second one of the one or more gas compression ramps, and so on to an Nth one of the one or more gas compression ramps. Each of the strakes S has an upstream or inlet side and a downstream or outlet side. For rotor balance and gas compression efficiency purposes, in one embodiment the number X of gas compression ramps R and the number of strakes N are the same positive integer number, and in such embodiment, N and X is at least equal to two. In an embodiment shown herein, the number of strakes N and the number X of gas compression ramps R are both equal to three. The compressed gases exiting from each of the one or more gas compression ramps is effectively prevented from "short circuiting" or returning to the inlet side of subsequent gas compression ramps by the strakes S. More fundamentally, the strakes S act as a large screw compressor fan or pump to move compressed gases along with each turn of the rotor.

To accommodate the specific strength requirements of high speed rotating service, various embodiments for an acceptable high strength rotor are feasible. In one embodiment, the rotor section may comprise a carbon fiber disc. In another, it may comprise a high strength steel hub. In each case, the gas compression ramps and strakes S may be integrally provided, or rim segments and gas compression modules may be releasably and replaceably affixed to the rotor.

Attached at the radial edge of the rotor are one or more of the at least one gas compression ramps. The gas compression ramps are situated so as to engage and to compress that portion of the entering gas stream which is impinged by the gas compression ramp upon its rotation, which in one embodiment, is about the aforementioned drive shaft. The compressed gases escape rearwardly from the gas compression ramp, and decelerate and expands outwardly into a gas expansion diffuser space or volute, prior to entering a compressed gas outlet nozzle.

Finally, many variations in the gas flow configuration and in provision of the inlet gas pre-swirl compression, and in providing outlet gas passageways, may be made by those skilled in the art without departing from the teachings hereof. Finally, in addition to the foregoing, my gas compressor is simple, durable, and relatively inexpensive to manufacture and to maintain.

BRIEF DESCRIPTION OF THE DRAWING

In order to enable the reader to attain a more complete appreciation of the invention, and of the novel features and the advantages thereof, attention is directed to the following detailed description when considered in connection with the accompanying drawings, wherein.

The foregoing figures, being merely exemplary, contain various elements that may be present or omitted from actual implementations depending upon the circumstances. An attempt has been made to draw the figures in a way that illustrates at least those elements that are significant for an understanding of the various embodiments and aspects of the invention. However, various other elements of the supersonic gas compressor, especially as applied for different variations of the functional components illustrated, embodiments, may be utilized in order to provide a robust supersonic gas compression unit still within the overall teachings of the present invention, and the legal equivalents thereof.

DETAILED DESCRIPTION

Figure 1:
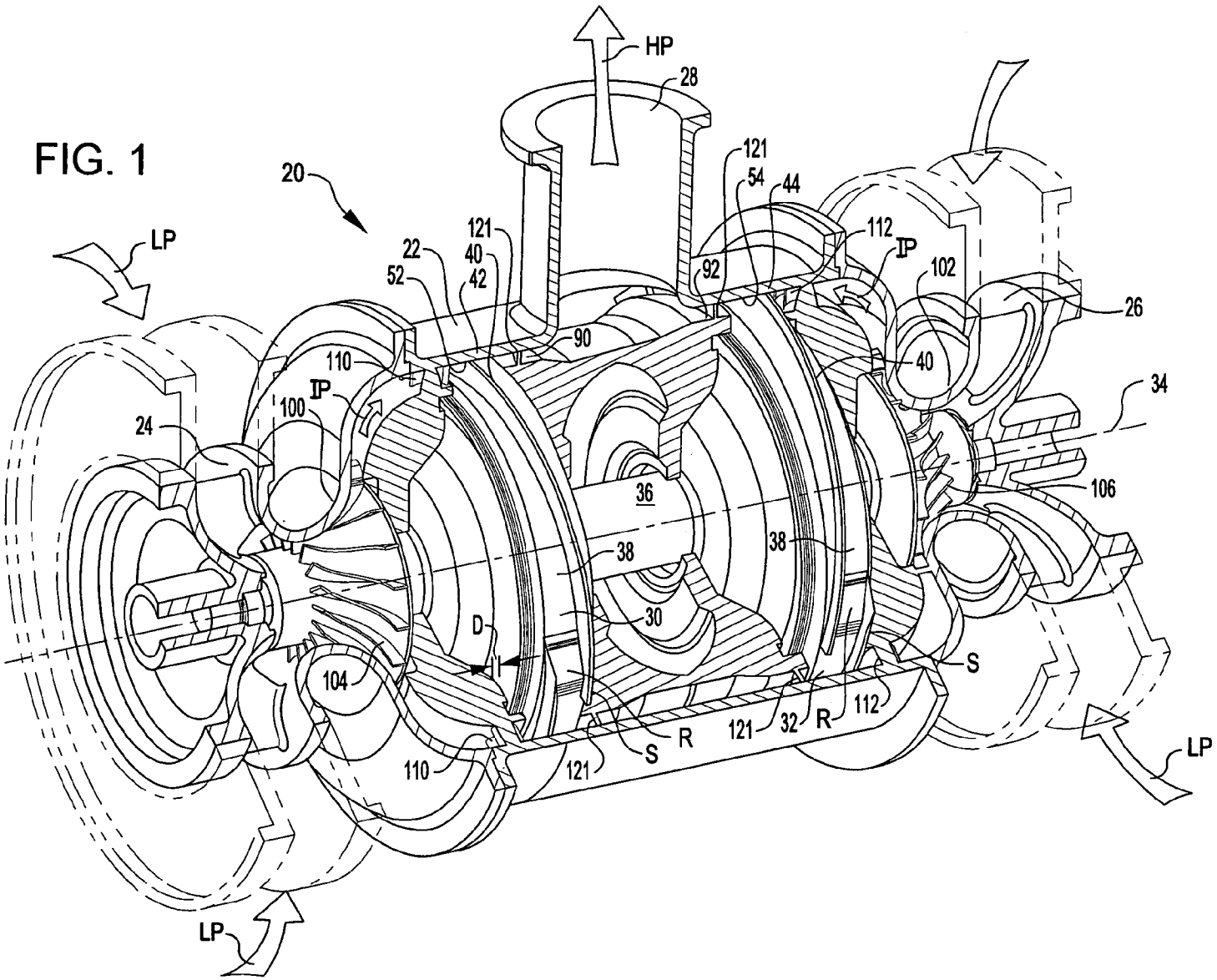
FIG. 1 provides a partially cut away perspective view of a gas compressor, showing the use of two supersonic gas compressor wheels mounted on a common shaft, and with an integrally mounted, directly driven centrifugal inlet pre-swirl gas impeller wheel mounted in each inlet gas stream to compress the inlet low pressure gas from a gas source to an intermediate pressure before feed to each of the supersonic gas compressors.

Referring now to the drawing, FIG. 1 depicts a partial cut-away perspective view of my novel supersonic gas compression apparatus 20. Major components shown in this FIG. 1 include a stationary housing or case 22 having first 24 and second 26 inlets for supply of low pressure gas to be compressed, and a high pressure compressed gas outlet nozzle 28. In this dual unit design, a first rotor 30 and a second rotor 32 are provided, each having a central axis defined along centerline 34, here shown defined by common shaft 36, and adapted for rotary motion therewith, in case 22. Each one of the first 30 and second 32 rotors extends radially outward from its central axis to an outer surface portion 38, and further to an outer extremity 40 on the strakes S. On each one of first 30 and second 32 rotors, one or more supersonic shock compression ramps R are provided. Each one of the supersonic shock compression ramps R forms a feature on the outer surface portion 38 of its respective first 30 or second 32 rotor. Within housing 22, a first circumferential stationary interior peripheral wall 42 is provided radially outward from first rotor 30. Likewise a second circumferential stationary interior peripheral wall 44 is provided radially outward from second rotor 32. Each one of the stationary peripheral walls 42 and 44 are positioned radially outward from the central axis defined by centerline 34, and are positioned very slightly radially outward from the outer extremity 40 of first 30 and second 32 rotors, respectively. Each one of the first and second stationary peripheral walls 42 and 44 have an interior surface portion 52 and 54, respectively. Each one of the one or more supersonic shock compression ramps R cooperates with the interior surface portion 52 and 54 of one of the stationary peripheral walls 42 or 44 to compress gas therebetween.

Figure 4:
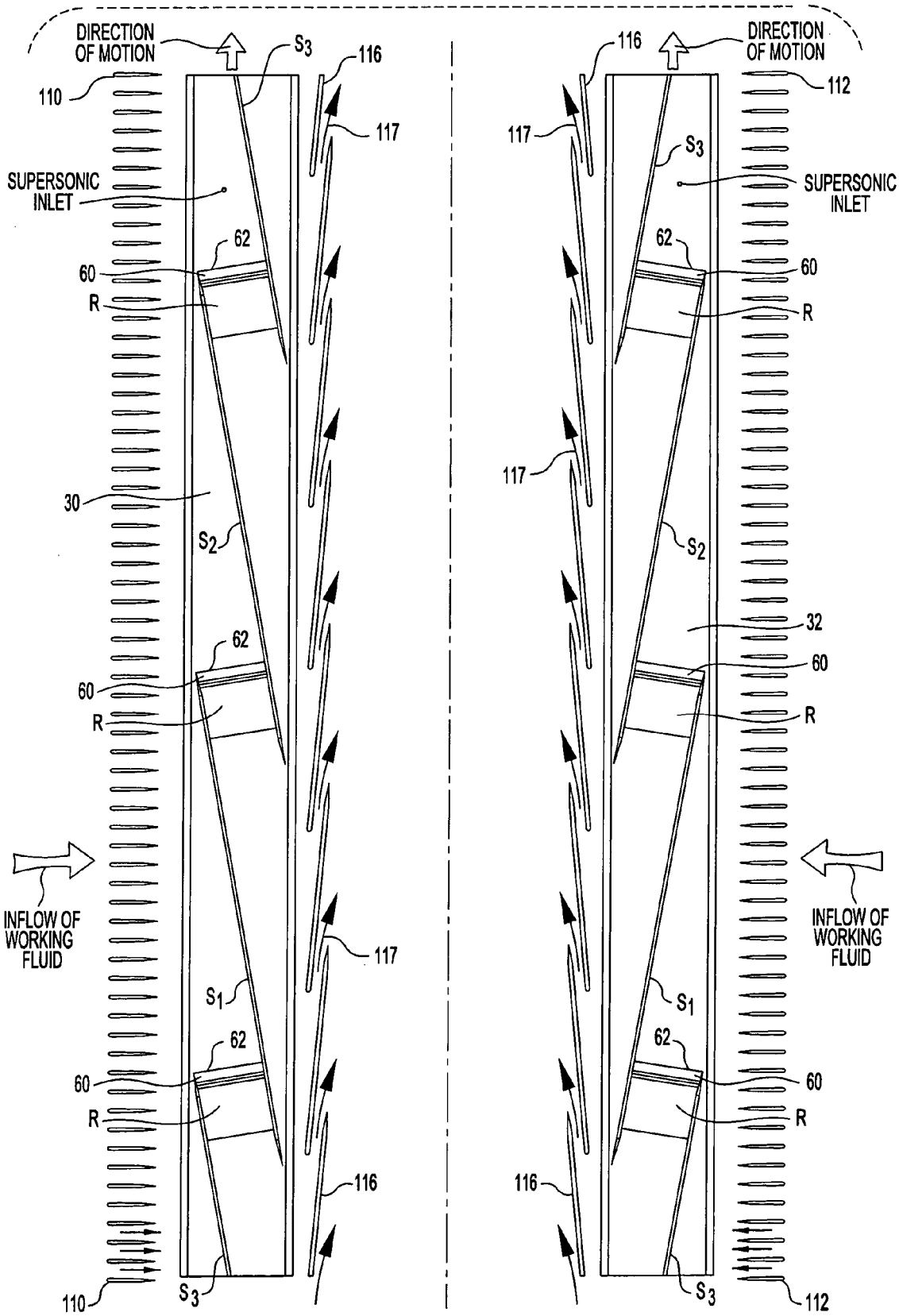
FIG. 4 illustrates a circumferential view of the gas flow path into and out of the rotating shock compressor wheel, without an inflow pre-swirl feature, in that the inlet guide vanes function only as a flow straightener imparting no pre-swirl into the flow before it is ingested by the shock compression ramp on the rotor; this figure also illustrates the use of a radial diffuser downstream of the discharge side of the rotating shock compression ramp.
Figure 5:
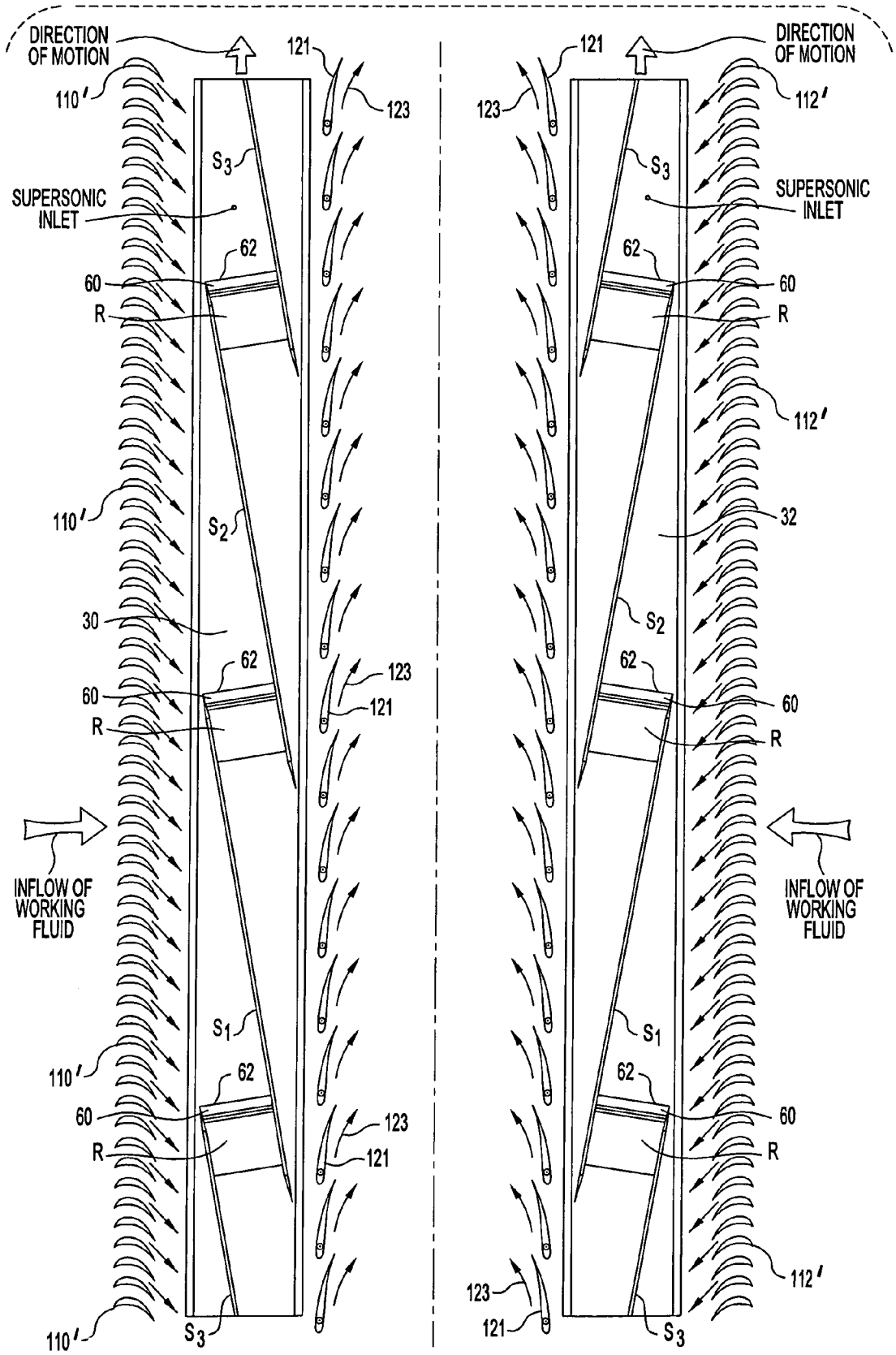
FIG. 5 illustrates a circumferential view of the gas flow path into and out of the rotating shock compressor wheel, similar to the view just provided in FIG. 4, but now providing illustrating the use of an inlet guide vane array that imparts pre-swirl into the gas flow prior to entry into the shock compression ramp on the rotor; this figures also illustrates the use of a stationary diffusion cascade that achieves flow expansion largely in the axial direction.
Figure 6:
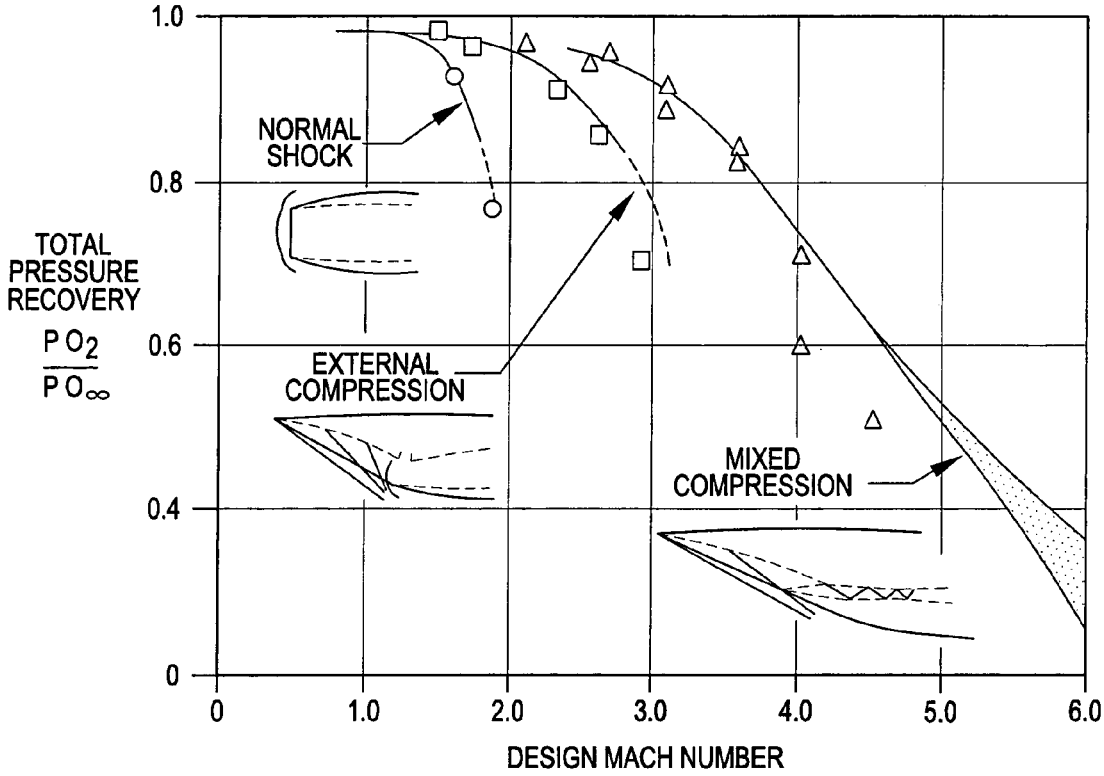
FIG. 6 PRIOR ART
FIG. 6 provides a comparison of various prior art compression efficiencies, in terms of total pressure ratio, based on three different types of inlets utilized in supersonic flight applications, namely, normal shock compression, external shock compression, and mixed compression, to enable the reader to appreciate the advantages provided by integrating the features of external and mixed compression inlets in the compressor design disclosed and claimed herein; note that a small illustration of the shock pattern is provided for each type of inlet for which data is provided.

One or more helical strakes S are provided adjacent each one of the one or more supersonic compression ramps R. An outwardly extending wall portion $S_w$ of each of the one or more strakes S extends outward from at least a portion of the outer surface portion 38 of its respective rotor 30 or 32 along a height HH (see FIG. 9) to a point adjacent the respective interior surface portion 52 or 54 of the peripheral wall 42 or 44. The strakes S effectively separate the low pressure inlet gas from high pressure compressed gas downstream of each one of the supersonic gas compression ramps R. Strakes S are, in the embodiment illustrated by the circumferential flow paths depicted in FIGS. 4 and 5, provided in a helical structure extending substantially radially outward from the outer surface portion 38 of its respective rotor 30 or 32. As shown in FIGS. 4 and 5, the number of the one or more helical strakes S is N, and the number of the one or more supersonic gas compression ramps R is X, and the number N of strakes S is equal to the number X of compression ramps R. The strakes $S_1$ through $S_N$ partition entering gas so that the gas flows to the respective gas compression ramp R then incident to the inlet area of the gas compressor. As can be appreciated from FIG. 9, the preferably helical strakes $S_1$, $S_2$, and $S_3$ are thin walled, with about 0.15" width (axially) at the root, and about 0.10" width at the tip. With the design illustrated herein, it is believed that leakage of gases will be minimal.

For rotor 30 or 32 balance purposes, we prefer that the number X of gas compression ramps R and the number N of strakes S be the same positive integer number, and that N and X each be at least equal to two. In one embodiment, N and X are equal to three as illustrated herein. The strakes $S_1$ through $S_N$ allow feed of gas to each gas compression ramp R without appreciable bypass of the compressed high pressure gas to the entering low pressure gas. That is, the compressed gas is effectively prevented by the arrangement of strakes S from "short circuiting" and thus avoids appreciable efficiency losses. This strake feature can be better appreciated by evaluating the details shown in FIG. 9, where strakes $S_1$ and $S_2$ revolves in close proximity to the interior wall surface 52. The strakes $S_1$ and $S_2$ have a localized height HS1 and a localized height $HS_2$, respectively, which extends to a tip end $TS_1$ and $TS_2$ respectively, that is designed for rotation very near to the interior peripheral wall surface of housing 22, to allow for fitting in close proximity to the tip end $TS_1$ or $TS_2$ with that wall.

Figure 3:
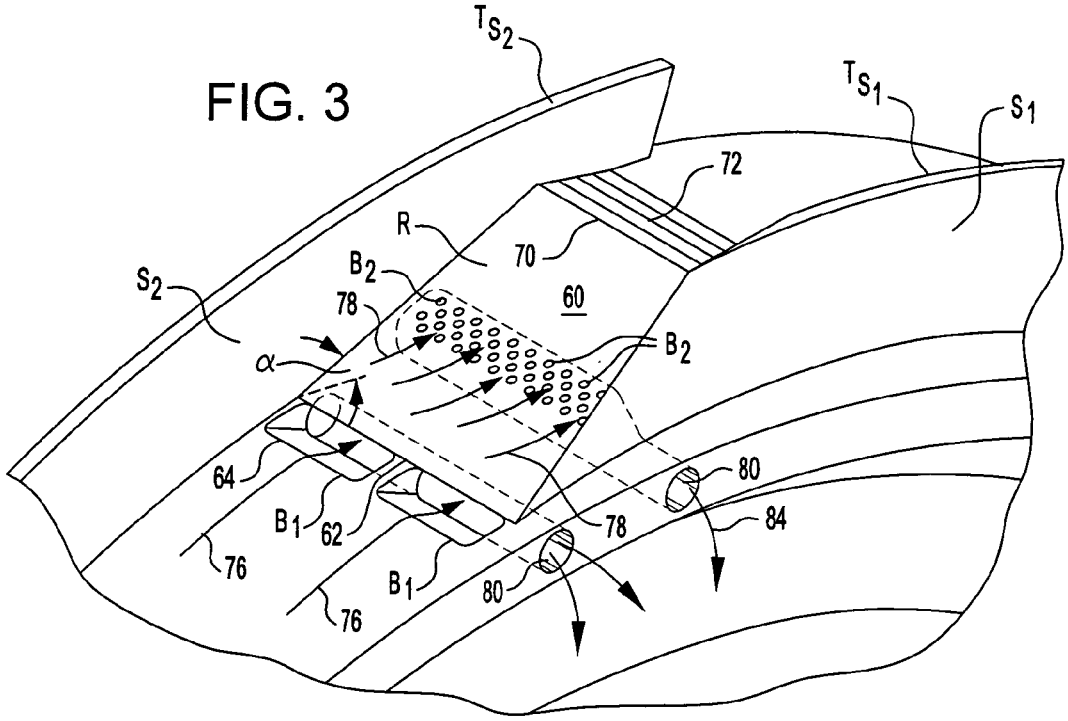
FIG. 3 is a perspective view providing a close up of the compression ramp portion on a rotor, showing bleed ports for accommodating bleed of boundary layer gas at two positions on the gas compression ramp, as well as showing outlets for each bleed port into the rotor wheel space.

As seen in FIG. 3, in each of the gas compression ramps R, the inlet gas stream is compressed at apparent supersonic velocity, to create an oblique/normal shock structure between the respective gas compression ramp and the adjacent peripheral wall. Each of the one or more gas compression ramps R has an outwardly sloping gas compression ramp face 60. The face 60 has a base 62 which is located adjacent the intersection of the outwardly sloping face 60 and the outer surface portion 38 of the respective rotor 30 or 32. The face 60 and the outer surface 38 of rotors 30 and 32 intersect at a preselected angle alpha $\alpha$ of from about one (1) degree to about fifteen (15) degrees, which angle alpha $\alpha$ will vary based on the design Mach number and gas properties, such as temperature and density. The gas compression ramps R also include a throat 70, and downstream thereof, an inwardly sloping gas deceleration section 72. The deceleration-transition section 72 is provided to step-down to the outer surface 38 of the rotor 30 or 32.

For improving efficiency, each of the one or more gas compression ramps R has one or more boundary layer bleed ports B. In the configuration illustrated in FIG. 3, at least one of the one or more boundary bleed ports B is located at the base 62 of the gas compression ramp R. As depicted, a pair of shovel-scoop shaped cutouts $B_1$ are shown, each having a generally parallelepiped sidewall 64 configuration. Bleed air enters structures $B_1$ as indicated by reference arrows 76 in FIG. 3. Also, as shown in FIG. 3, at least one of the one or more boundary bleed ports $B_2$ are located on the face 60 of the gas compression ramp R. Bleed air enters structures $B_2$ as indicated by reference arrows 78 in FIG. 3. As depicted in FIG. 3, each one of the gas compression ramps R further comprise a bleed air receiving chamber 80, each of which is configured for effectively containing therein, for ejection therefrom, bleed air provided thereto, as indicated by exit bleed air reference arrows 84 in FIG. 3.

As depicted in FIG. 1, downstream of each of first 30 and second 32 rotors is a first 90 and second 92 high pressure outlet, respectively, each configured to receive and pass therethrough high pressure outlet gas resulting from compression of gas by the one or more gas compression ramps R on the respective rotor 30 or 32. One or more combined high pressure gas outlet nozzles 28 can be utilized, as shown in FIG. 1, to receive the combined output from the first and second high pressure outlets 90 and 92 from rotors 30 and 32.

For improved efficiency and operational flexibility, the compressor 20 may be designed to further include a first inlet casing 100 and a second inlet casing 102 having therein, respectively, first 104 and second 106 pre-swirl impellers. These pre-swirl impellers 104 and 106 are located intermediate the low pressure gas inlets 24 and 26, and their respective first 30 or second 32 rotors. Each of the pre-swirl impellers 104 and 106 are configured for compressing the low pressure inlet gas LP to provide an intermediate pressure gas stream P at a pressure intermediate the pressure of the low pressure inlet gas LP and the high pressure outlet gas HP, as noted in FIG. 9. In one application for the apparatus depicted, air at ambient atmospheric conditions of 14.7 psig is compressed to about 20 psig by the pre-swirl impellers 104 and 106. However, such pre-swirl impellers can be configured to provide a compression ratio of up to about 2:1. More broadly, the pre-swirl impellers can be configured to provide a compression ratio from about 1.3:1 to about 2:1.

Also, for improving efficiency, the gas compressor 20 can be provided in a configuration wherein, downstream of the pre-swirl impellers 104 and 106, but upstream of the one or more gas compression ramps R on the respective rotors 30 and 32, a plurality of inlet guide vanes, are provided, a first set 110 or 110' before first rotor 30 and a second set 112 or 112' before second rotor 32. The inlet guide vanes 110' and 112' as illustrated in FIG. 5 impart a spin on gas passing therethrough so as to increase the apparent inflow velocity of gas entering the one or more gas compression ramps R. Additionally, such inlet guide vanes 110' and 112' assist in directing incoming gas in a trajectory which more closely matches gas flow path through the ramps R, to allow gas entering the one or more gas compression ramps to be at approximately the same angle as the angle of offset, to minimize inlet losses.

In one embodiment, as illustrated, the pre-swirl impellers 104 and 106 can be provided in the form of a centrifugal compressor wheel. As illustrated in FIG. 1, pre-swirl impellers 104 and 106 can be mounted on a common shaft 36 with the rotor 30 and 32. It is possible to customize the design of the pre-swirl impeller and the inlet guide vane set to result in a supersonic gas compression ramp inlet inflow condition with the same pre-swirl velocity or Mach number but a super-atmospheric pressure. Since the supersonic compression ramp inlet basically multiples the pressure based on the inflow pressure and Mach number, a small amount of supercharging at the pre-swirl impellers can result in a significant increase in cycle compression ratio.

In FIG. 4, a circumferential view of the gas flow path into and out of the rotating shock compressor wheel is provided, where the configuration is developed without an inflow pre-swirl feature, in that the inlet guide vanes 110 and 112 function only as a flow straightener, imparting no pre-swirl into the flow before it is ingested by the shock compression ramp R on the rotor 30 or 32. Note that this figure also illustrates the use of a radial diffuser having a plurality of radial diffuser blades 116, downstream of the discharge side of the rotating shock compression ramp R, to then deflect compressed high pressure gas HP outward toward outlet (90 or 92, shown in FIG. 1) in the direction of reference arrows 117.

FIG. 5 illustrates a circumferential view of the gas flow path into and out of the rotating shock compressor R on rotor wheels 30 and 32, similar to the view just provided in FIG. 4, but now further illustrating the use of an array of inlet guide vanes 110' and 112' that imparts pre-swirl into the gas flow prior to entry into the shock compression ramp R on the rotor 30 or 32. Note that this figure also illustrates the use of a stationary diffusion cascade blades 121 that achieves flow expansion largely in the axial direction, as shown by reference arrows 123.

With (or without) the aid of pre-swirl impellers 104 and 106, it is important that the apparent velocity of gas entering the one or more gas compression ramps R is in excess of Mach 1, so that the efficiency of supersonic shock compression can be exploited. However, to increase efficiency, it would be desirable that the apparent velocity of gas entering the one or more gas compression ramps R be in excess of Mach 2. More broadly, the apparent velocity of gas entering the one or more gas compression ramps R can currently practically be between about Mach 1.5 and Mach 3.5, although wider ranges are certainly possible within the teachings hereof.

Figure 9:
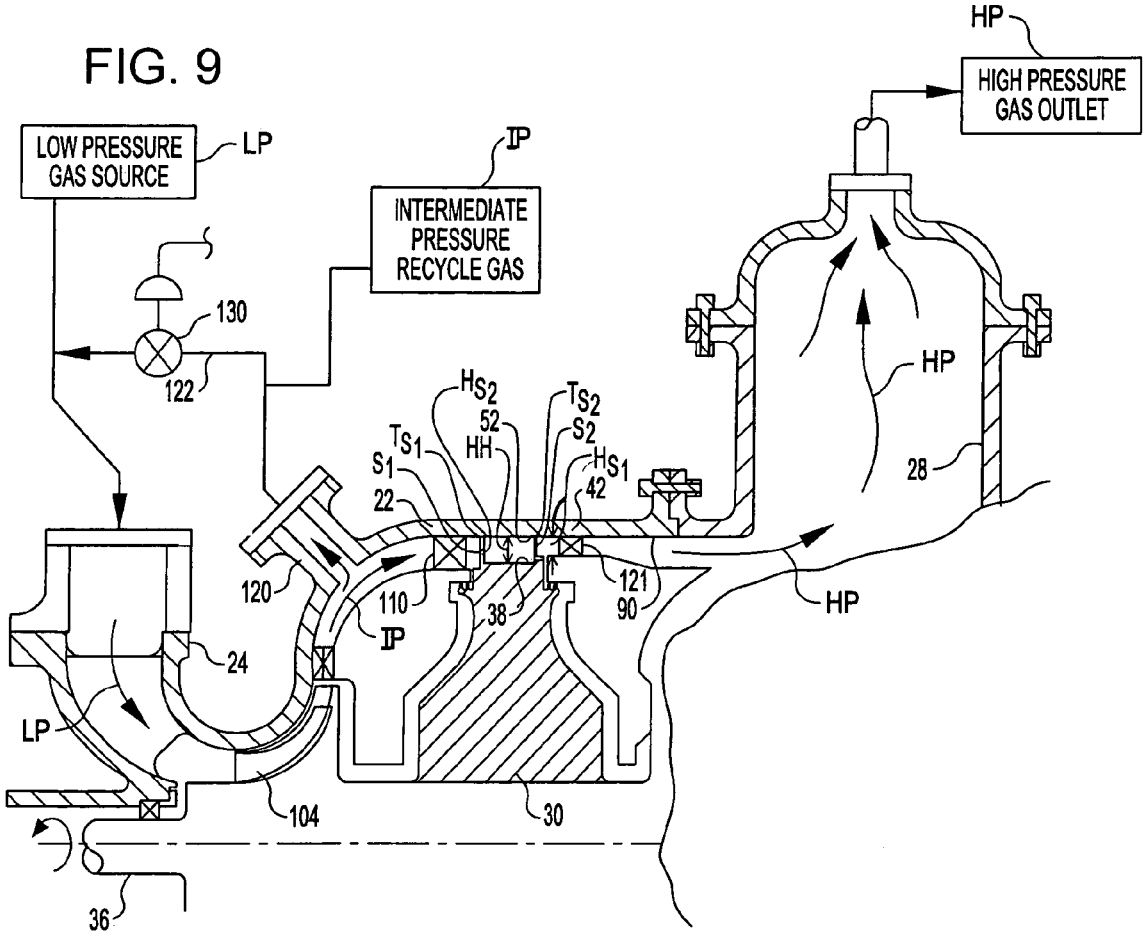
FIG. 9 provides a partial cross-sectional view of one embodiment for a novel supersonic gas compressor, and further illustrates, from a process flow diagram point of view, the use of intermediate gas bypass which enables provision of variable inlet mass flow to the supersonic compression ramp on a constant speed rotor, and which incidentally also shows the close fitting relationship of the rotor strakes with the interior surface of the stationary peripheral wall against which gas compression occurs, and one position of strakes as the rotor turns about its axis of rotation.

As depicted in FIG. 9, another aspect of the current invention is the provision, where desirable for maintaining relatively high efficiency at reduced mass flows from design maximum flow rate of the compressor 20, to further include, adjacent the outlet of the pre-swirl impeller 104 or 106, an outlet 120 for intermediate pressure gas, and a bypass line 122 between the intermediate outlet 120 and the gas inlet 24, so that the bypass line 122 is configured to route a portion of the gas at the intermediate pressure to the gas inlet 24. In this configuration, it is advantageous to utilize gas flow regulating valve 130. The valve 130 is configured to vary the rate of passage of intermediate pressure gas therethrough, so as to in turn vary the amount of intermediate pressure gas entering the one or more gas compression ramps R on rotor 30. From the other discussion herein, it should be clear to one of ordinary skill in the art and to whom this specification is directed that a duplicate valve 130 may be provided with respect to a second rotor 32 for achieving equivalent results (i.e., mirror image of the portion shown in FIG. 9). In one embodiment, valve 130 is adjustable at any preselected flow rate from (a) a closed position, wherein the valve 130 seals the bypass line 122, so that as a result substantially no intermediate pressure gas escapes to the gas inlet, and (b) an open position, wherein the valve 130 allows fluid communication between the pre-swirl impeller outlet 120 and the gas inlet, or (c) a preselected position between the closed position and the open position.

Figure 7:
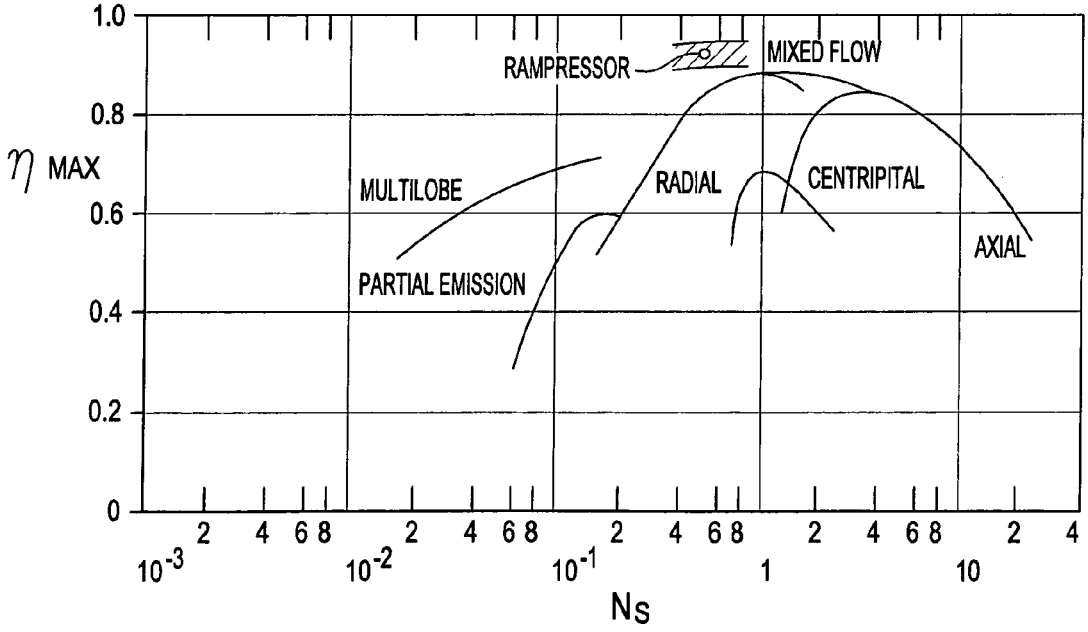
FIG. 7 provides an overview of comparative isentropic compression efficiencies for different types of compressors as a function of non-dimensional specific speed, indicating how the novel supersonic gas compressor disclosed herein can out perform other types of compressors for a certain range of specific speeds.
Figure 8:
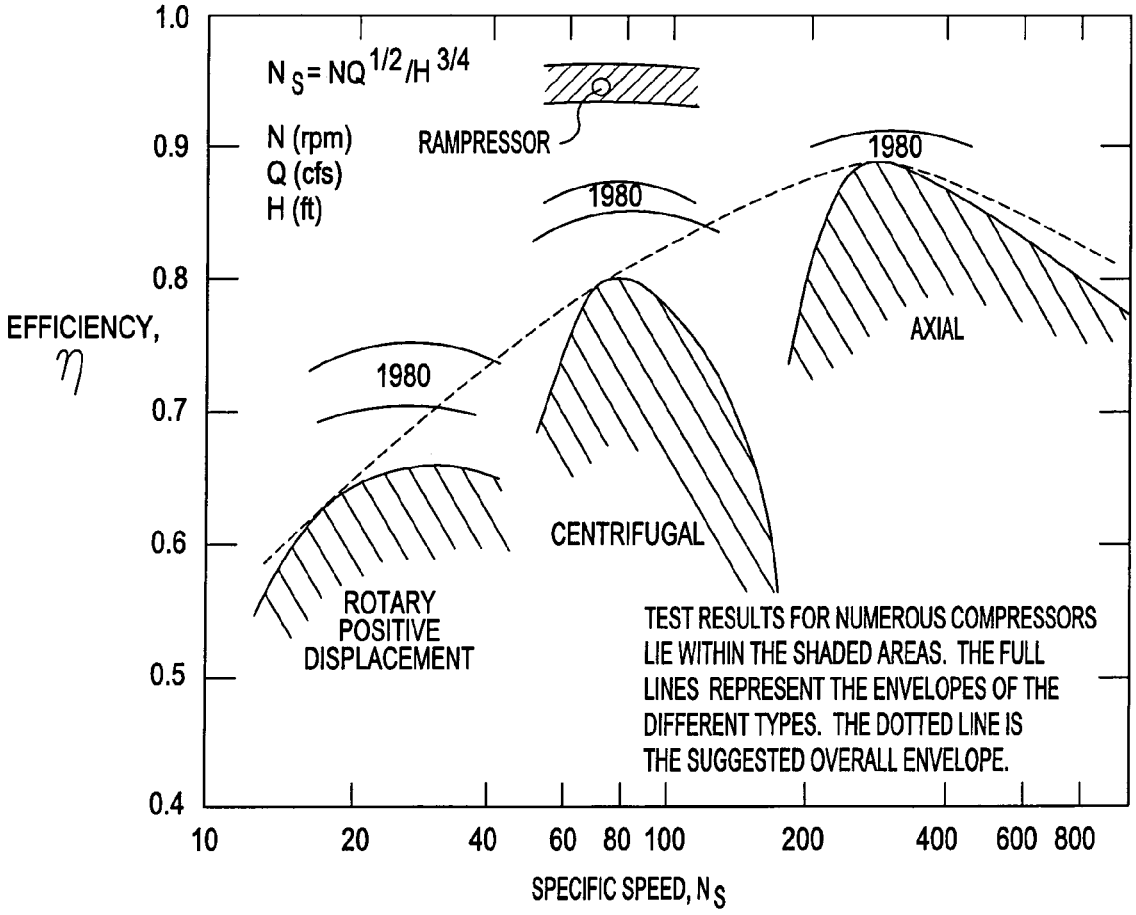
FIG. 8 provides an overview of comparative isentropic compression efficiencies for different types of compressors as a function of non-dimensional specific speed, and also indicates how the novel supersonic gas compressor disclosed herein can out perform other types of compressors for a certain range of specific speeds.

The compressor 20 provides an ideal apparatus for the compression of various gases, including (a) air, (b) refrigerant, (c) steam, and (d) hydrocarbons. In various applications, it has been calculated that compressor 20 is capable of providing compression of a selected gas at an isentropic efficiency in excess of ninety (90) percent, as is graphically illustrated in FIGS. 7 and 8. The compressor 20 operates most efficiently at a non-dimensional specific speed from about 60 to about 120. As further depicted in FIG. 8, the compressor 20 is capable of compressing a selected gas at an isentropic efficiency in excess of ninety five percent.

Figure 2:
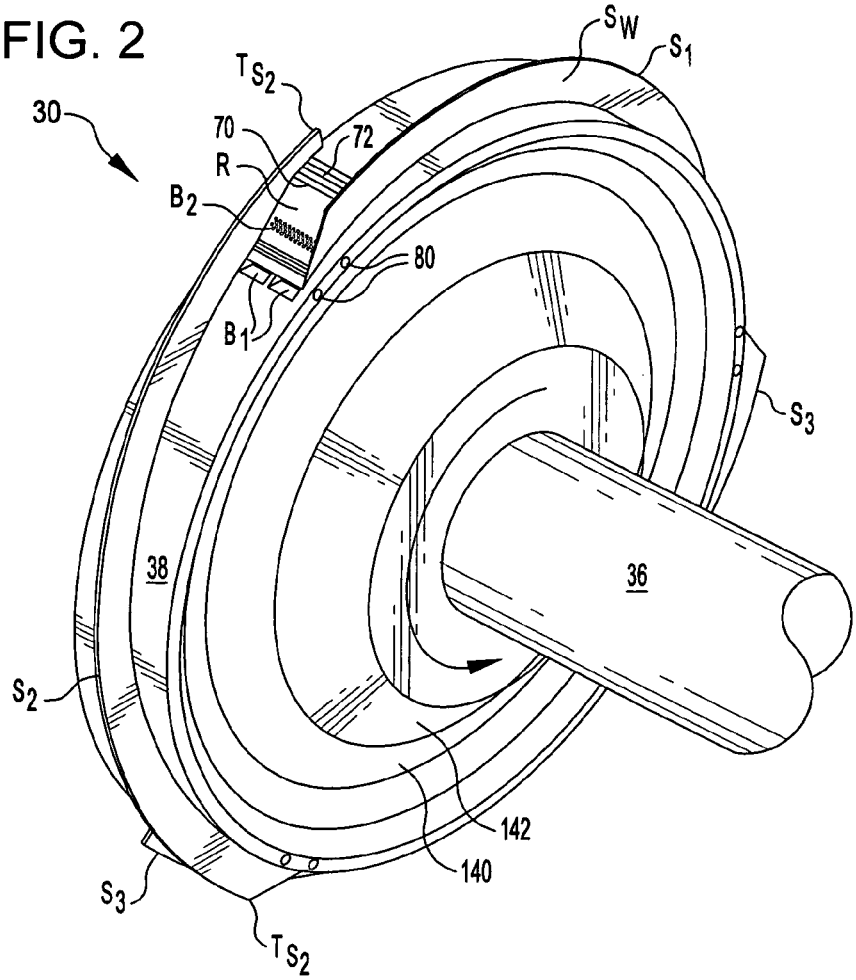
FIG. 2 provides a perspective view of a rotor for one of the supersonic gas compressors, and in particular, illustrating the gas compression ramp provided with the rotor, the helical strakes, and bleed ports for controlling the boundary layer flow on the gas compression ramp.

For assuring operation at high rotational speed, to achieve high apparent Mach number at the inlet of each of the one or more gas compression ramps R, a high strength rotor 30 or 32 is provided. In one embodiment, such rotors include a high strength central disc. As illustrated in FIG. 2, such rotors, and in particular a central disc portion 140, may include a tapered portion 142, at least in part, i.e., that is thinner at increasing radial distance from the center of rotation. To increase aerodynamic efficiency, at least a portion of such rotor can be confined within a close fitting housing having a minimal distance D between an outer surface of the rotor and an inner surface of the close fitting housing, so as to minimize aerodynamic drag on the rotor. These aspects of the design of such compressors 20 can be seen in FIG. 1.

The compressor 20 disclosed herein allows practice of unique methods of compressing gases. Practice of such methods involves providing one or more gas compression ramps on a rotor which is rotatably secured for high speed rotary motion with respect to stationary housing having an inner surface. Each of the one or more gas compression ramps is provided with an inlet, low pressure gas stream. The low pressure gas is compressed between one of the one or more gas compression ramps and the inner surface of the stationary housing which is located circumferentially about the rotor, to generate a high pressure gas therefrom. To achieve gas compression, and to avoid bypass of the compressed gas back to the entering low pressure gas stream, one or more helical, substantially radially extending strakes are provided along the periphery of the rotor. Each on of the one or more strakes S is provided adjacent to one of the one or more gas compression ramps R. At least a portion of each of the one or more strakes S extends outward from at least a portion of an outer surface portion of the rotor to a point adjacent to the inner surface of the stationary housing. The rotor is driven by application of mechanical power to an input shaft operatively connected to the rotor, and thus to each of the one or more gas compression ramps. In one embodiment, the apparent inlet velocity of the one or more gas compression ramps, i.e., the approach speed between incoming gas and the opposing motion of a selected gas compression ramp R, is at least Mach 1.5. More broadly, the apparent inlet velocity of the one or more gas compression ramps is between Mach 1.5 and Mach 4. At the design point in one embodiment, the apparent inlet velocity of said gas compression ramps is approximately Mach 3.5.

This method of gas compression allows high efficiency compression of a variety of commonly compressed gases, including (a) air, (b) steam, (c) refrigerant, and (d) hydrocarbons. Some important applications include compression of air, natural gas, refrigerants in refrigeration and air conditioning, applications, and steam in various services.

Overall, the designs incorporated into compressor 20 provide for minimizing aerodynamic drag, by minimizing the number of leading edge surfaces subjected to stagnation pressure within the compressor. In one embodiment, as illustrated herein, the number of leading edge surfaces subjected to stagnation pressure is less than five. And, each of the one or more gas compression ramps are circumferentially spaced equally apart so as to engage a supplied gas stream substantially free of turbulence from the previous passage through a given circumferential location of any one said one or more gas compression ramps. The cross sectional areas of each of the one or more gas compression ramps can be sized and shaped to provide a desired compression ratio. Further, the helical strakes can be offset at a preselected angle delta, and wherein the angle of offset matches the angle of offset of each one of the one or more gas compression ramps, and wherein so that the angles match to allow gas entering the one or more gas compression ramps to be at approximately the same angle as the angle of offset, to minimize inlet losses.

The rotors 30 and 32 are rotatably secured in an operating position by a fixed support stationary housing or casing 22 in a manner suitable for extremely high speed operation of the rotors 30 and 32, such as rotation rates in the range of 10,000 to 20,000 rpm, or even up to 55,000 rpm, or higher. In this regard, bearing assemblies must provide adequate bearing support for high speed rotation and thrust, with minimum friction, while also sealing the operating cavity, so as to enable provision of a vacuum environment adjacent the rotor disc, to minimize drag. The detailed bearing and lubrication systems may be provided by any convenient means by those knowledgeable in high speed rotating machinery, and need not be further discussed herein. However, note that in the embodiment shown in FIG. 1, with "back-to-back" mounting of opposing pre-swirl impellers and opposing rotor discs, the thrust vectors created during compression are effectively eliminated since they are basically created in equal but opposite directions by the opposing rotors and pre-swirl impellers.

It is to be appreciated that the various aspects and embodiments of a supersonic gas compressor, and the method of operating such devices as described herein are an important improvement in the state of the art. The novel supersonic gas compressor is simple, robust, reliable, and useful for work in various gas compression applications. Although only a few exemplary embodiments have been described in detail, various details are sufficiently set forth in the drawings and in the specification provided herein to enable one of ordinary skill in the art to make and use the invention(s), which need not be further described by additional writing in this detailed description.

Importantly, the aspects and embodiments described and claimed herein may be modified from those shown without materially departing from the novel teachings and advantages provided by this invention, and may be embodied in other specific forms without departing from the spirit or essential characteristics thereof. Therefore, the embodiments presented herein are to be considered in all respects as illustrative and not restrictive. As such, this disclosure is intended to cover the structures described herein and not only structural equivalents thereof, but also equivalent structures. Numerous modifications and variations are possible in light of the above teachings. It is therefore to be understood that within the scope of the appended claims, the invention(s) may be practiced otherwise than as specifically described herein. Thus, the scope of the invention(s), as set forth in the appended claims, and as indicated by the drawing and by the foregoing description, is intended to include variations from the embodiments provided which are nevertheless described by the broad interpretation and range properly afforded to the plain meaning of the claims set forth below.

What is claimed is:

1. A gas compressor, said compressor comprising:

(a) an inlet for supply of gas to be compressed;

(b) a rotor, said rotor having a central axis and adapted for rotary motion thereabout, said rotor extending radially outward from said central axis to an outer surface portion having an outer extremity;

(c) one or more supersonic shock compression ramps, each one of said supersonic shock compression ramps forming a features on said outer surface portion of said rotor;

(d) a stationary peripheral wall, said stationary peripheral wall (i) positioned radially outward from said central axis, and (ii) positioned very slightly radially outward from said outer extremity of said rotor; and (iii) having an interior surface portion;

(e) said one or more supersonic shock compression ramps and said stationary peripheral wall cooperating to compress said gas therebetween;

(f) one or more strakes, each of said one or more strakes provided adjacent to one of said or more supersonic compression ramps, and at least a portion of each of said one or more strakes extending outward from at least a portion of said outer surface portion of said rotor to a point adjacent said interior surface portion of said peripheral wall;

(g) whereby said one or more strakes effectively separate said inlet gas from compressed gas downstream of each one of said supersonic gas compression ramps.

2. The apparatus as sea forth in claim 1, wherein each of said one or more strakes comprises a helical structure extending substantially radially from said outer surface portion of said rotor.

3. The apparatus as set forth in claim 2, wherein the number of said one or more helical strakes is N, and the number of said one or more supersonic gas compression ramps is X, and wherein N and X are equal.

4. The apparatus as set forth in claim 1 or in claim 2, wherein each of said one or more gas compression ramps comprises a outwardly sloping gas compression ramp face, said face having a base, said base located adjacent the intersection of said outwardly sloping face and said outer surface portion of said rotor.

5. The apparatus as set forth in claim 4, wherein said face and said outer surface of said rotor intersect at an angle alpha $\alpha$ from about one degree to about fifteen degrees.

6. The apparatus as set forth in claim 1, wherein each of said one or more gas compression ramps further comprise one or more boundary layer bleed ports.

7. The apparatus as set forth in claim 6, wherein at least one of said one or more boundary bleed ports is located at said base of said gas compression ramps.

8. The apparatus as set forth in claim 6, wherein at least one of said one or more boundary bleed ports is located on said face of said gas compression ramp.

9. The apparatus as set forth in claim 6, wherein each of said gas compression ramps further comprise a bleed air receiving chamber, and wherein each of said bleed air receiving chambers effectively contains therein, for ejection therefrom, bleed air provided thereto.

10. The apparatus as sea forth in claim 1, wherein said gas compression ramps further comprise (a) a throat, and (b) an inwardly sloping gas deceleration ramp.

11. The apparatus as set forth in claim 1, further comprising an outlet, said outlet configured to receive and pass therethrough high pressure outlet gas after resulting from compression of gas by said one or more gas compression ramps on said rotor.

12. The apparatus as set forth in claim 11, further comprising an inlet casing containing therein a pre-swirl impeller, said pre-swirl impeller located intermediate said gas inlet and said rotor, said pre-swirl impeller configured for compressing said inlet gas to a pressure intermediate the pressure of said inlet gas and said outlet gas.

13. The apparatus as set forth in claim 12, wherein said pre-swirl impeller is configured to provide a compression ratio of up to about 2:1.

14. The apparatus as set forth in claim 12, wherein said pre-swirl impeller is configured to provide a compression ratio from about 1.3:1 to about 2:1.

15. The apparatus as set forth in claim 12, further comprising, downstream of said pre-swirl impeller and upstream of said one or more gas compression ramps on said rotor, a plurality of inlet guide vanes, said inlet guide vanes imparting spin on gas passing therethrough so as to increase the apparent inflow velocity of gas entering said one or more gas compression ramps.

16. The apparatus as set forth in claim 15, wherein said pre-swirl impeller comprises a centrifugal compressor.

17. The apparatus as set forth in claim 16, wherein said pre-swirl impeller is mounted on a common shaft with said rotor.

18. The apparatus as set forth in claim 15, wherein the apparent velocity of gas entering said one or more gas compression ramps is in excess of Mach 1.

19. The apparatus as set forth in claim 15, wherein the apparent velocity of gas entering said one or more gas compression ramps is in excess of Mach 2.

20. The apparatus as set forth in claim 15, wherein the apparent velocity of gas entering said one or more gas compression ramps is between about Mach 1.5 and Mach 3.5.

21. The apparatus as set forth in claim 12, or in claim 20, wherein said pre-swirl impeller has an outlet for intermediate pressure gas, and wherein said apparatus further comprises a bypass line between said intermediate outlet and said gas inlet, said bypass line configured to route a portion of said gas at said intermediate pressure to said inlet.

22. The apparatus as set forth in claim 21, further comprising a gas flow regulating valve, said valve configured to vary the rate of passage of intermediate gas therethrough, so as to in turn vary the amount of intermediate pressure gas entering said one or more gas compression ramps.

23. The apparatus as set forth in claim 22, where in said valve is adjustable at any preselected flow rate from (a) a closed position, wherein said valves forms a seal in said bypass line, so that as a result substantially no intermediate pressure gas escapes to said gas inlet, and (b) an open position, wherein said valve allows fluid communication between said pre-swirl impeller outlet and said gas inlet, or (c) a preselected position between said closed position and said open position.

24. A gas compressor, comprising:

(a) a support structure, said support structure comprising (i) a circumferential housing with an inner side surface, and (ii) a gas inlet for receiving low pressure inlet gas;

(b) a first drive shaft, said first drive shaft rotatably secured along an axis of rotation with respect to said support structure;

(c) a first rotor, said first rotor rotatably affixed with said first output shaft for rotation with respect to said support structure, said first rotor further comprising a first circumferential portion having a first outer surface portion, said first rotor comprising one or more gas compression ramps, each one of said gas compression ramps comprising a portion integrally provided as part of said circumferential portion of said first rotor, (d) said gas compressor adapted to utilize at least a portion of said inner side surface of said first circumferential housing to compress said inlet gas thereagainst;

(e) one or more strakes on said first rotor, wherein one of said one or more strakes on said first rotor is provided for each of said one or more gas compression ramps, and wherein each of said one or more strakes on said first rotor extends outward from at least a portion of said circumferential portion of said first rotor to a point adjacent to said inner side surface of said first circumferential housing; and (f) a first high pressure compressed gas outlet;

(g) a second rotor, said second rotor rotatably affixed with said first output shaft for rotation with respect to said support structure, said second rotor further comprising a second circumferential portion having a second outer surface portion, said second rotor comprising one or more gas compression ramps, each one of said gas compression ramps comprising a portion integrally provided as part of said circumferential portion of said second rotor, (h) said gas compressor adapted to utilize at least a portion of said inner side surface of said second circumferential housing to compress said inlet gas thereagainst;

(i) one or more strakes on said second rotor, wherein one of said one or more strakes on said second rotor is provided for each of said one or more gas compression ramps, and wherein each of said one or more strakes on said second rotor extends outward from at least a portion of said circumferential portion of said second rotor to a point adjacent to said inner side surface of said second circumferential housing; and (j) a second high pressure compressed gas outlet.

25. The apparatus as set forth in claim 24, wherein said first and second high pressure gas outlets are in fluid communication with a single high pressure gas outlet nozzle.

26. The apparatus as set forth in claim 24, wherein each of said one or more strakes on said first rotor and on said second rotor comprises a helical structure extending substantially radially from said outer surface portion of said first rotor or said second rotor, respectively.

27. The apparatus as set forth in claim 26, wherein the number of said one or more helical strakes on said first rotor or on said second rotor is N, and the number of said one or more supersonic gas compression ramps on said first rotor or on said second rotor is X, and wherein N and X are equal.

28. The apparatus as set forth in claim 24, wherein each of said one or more gas compression ramps comprises a outwardly sloping gas compression ramp face, said face having a base, said base located adjacent the intersection of said outwardly sloping face and said outer surface portion of said first rotor of said second rotor.

29. The apparatus as set forth in claim 28 wherein each of said one or more gas compression ramps further comprise one or more boundary layer bleed ports.

30. The apparatus as set forth in claim 29, wherein at least one of said one or more boundary bleed ports is located at said base of said gas compression ramps.

31. The apparatus as set forth in claim 29, wherein at least one of said one or more boundary bleed ports is located on said face of said gas compression ramp.

32. The apparatus as set forth in claim 24, wherein each of said gas compression ramps further comprise a bleed air receiving chamber, and wherein each of said bleed air receiving chambers effectively contains therein, for ejection therefrom, bleed air provided thereto.

33. The apparatus as set forth in claim 24, further comprising a first inlet casing containing therein a first pre-swirl impeller, said first pre-swirl impeller located intermediate said gas inlet and said first rotor, said first pre-swirl impeller configured for compressing said inlet gas to a pressure intermediate the pressure of said inlet gas and said outlet gas.

34. The apparatus as set forth in claim 33, further comprising a second inlet casing containing therein a second pre-swirl impeller, said second pro-swirl impeller located intermediate said gas inlet and said second rotor, said second pre-swirl impeller configured for compressing said inlet gas to a pressure intermediate the pressure of said inlet gas and said outlet gas.

35. The apparatus as set forth in claim 34, wherein said first and said second pro-swirl impellers are configured to provide a compression ratio of up to about 2:1.

36. The apparatus as set forth in claim 35, wherein said first and said second pre-swirl impellers are configured to provide a compression ratio from about 1.3:1 to about 2:1.

37. The apparatus as set forth in claim 34, further comprising, downstream of said first and said second pre-swirl impellers and upstream of said one or more gas compression ramps on said first and said second rotors, respectively, a plurality of inlet guide vanes, said inlet guide vanes imparting spin on gas passing therethrough so as to increase the apparent inflow velocity of gas entering said one or more gas compression ramps on said first rotor and on said second rotor.

38. The apparatus as set forth in claim 34, wherein said first and said second pre-swirl impellers each comprise a centrifugal compressor.

39. The apparatus as set forth in claim 34, wherein said first and said second pre-swirl impeller is mounted on a common shaft with said first rotor and with said second rotor.

40. The apparatus as set forth in claim 34, wherein said first pre-swirl impeller has a first intermediate outlet, and wherein said apparatus further comprises a first bypass line between said first intermediate outlet and said first gas inlet, said first bypass line configured to route a portion of said gas at said intermediate pressure to said first inlet.

41. The apparatus as set forth in claim 40, wherein said second pre-swirl impeller has a second intermediate outlet, and wherein said apparatus further comprises a second bypass line between said second intermediate outlet and said second gas inlet, said second bypass line configured to route a portion of gas at said intermediate pressure to said second inlet.

42. The apparatus as set forth in claim 41, further comprising a first and a second gas flow regulating valve, each one of said first and second valves configured to vary the rate of passage of intermediate gas therethrough, so as to in turn vary the amount of intermediate pressure gas entering said one or more gas compression ramps on said first rotor and on said second rotor.

43. The apparatus as set forth in claim 42, where in said valves are adjustable at any preselected flow rate from (a) a closed position, wherein said valves form a seal in said first or in said second bypass line respectively, so that as a result substantially no intermediate pressure gas escapes to said first or said second gas inlets, and (b) an open position, wherein said valves allow fluid communication between said first and said second pre-swirl impeller outlets and said first and said second gas inlets, respectively, or (c) a preselected position between said closed position and said open position.

44. The apparatus as set forth in claim 24, wherein the apparent velocity of gas entering said one or more gas compression ramps is in excess of Mach 1.

45. The apparatus as set forth in claim 24, wherein the apparent velocity of gas entering said one or more gas compression ramps is in excess of Mach 2.

46. The apparatus as set forth in claim 24, wherein the apparent velocity of gas entering said one or more gas compression ramps is between about Mach 1.5 and Mach 3.5.

47. The apparatus as set forth in claim 1, or in claim 24, wherein said apparatus is configured to compress a gas selected from the group consisting of (a) air, (b) refrigerant, (c) steam, and (d) hydrocarbons.

48. The apparatus as set forth in claim 1, or in claim 24, wherein said apparatus compresses a selected gas at an isentropic efficiency in excess of ninety (95) percent.

49. The apparatus as set forth in claim 1, or in claim 24, wherein said apparatus compresses a selected gas at an isentropic efficiency in excess of ninety (90) percent.

50. The apparatus as set forth in claim 49, wherein said apparatus operates at a dimensioned specific speed from about 60 to about 120.

51. The apparatus as set forth in claim 50, wherein said apparatus compresses a selected gas at an isentropic efficiency in excess of ninety five percent.

52. The apparatus of claim 1, or claim 24, wherein said rotor comprises a central disc.

53. The apparatus of claim 52, wherein said central disc is tapered, at least in part.

54. The apparatus as set forth in claim 1, or in claim 24, wherein at least a portion of said rotor is confined within a close fitting housing having a minimal distance D between said rotor and said housing, so as to minimize aerodynamic drag on said rotor.

55. A method of compressing gas, comprising:

(a) providing one or more gas compression ramps on a rotor which is rotatably secured with respect to stationary housing having an inner surface;

(b) supplying to each of said one or more gas compression ramps an inlet gas stream;

(c) compressing said inlet gas stream between said one or more gas compression ramps and said stationary housing, to generate a high pressure gas therefrom;

(d) effectively separating inlet gas from high pressure gas by using one or more strakes along the periphery of said rotor, each of said one or more strakes provided adjacent to one of said or more gas compression ramps, and at least a portion of each of said one or more strakes extending outward from at least a portion of an outer surface portion of said rotor to a point adjacent said inner surface of said stationary housing;

(e) driving said rotor by an input shaft operatively connected to said one or more gas compression ramps.

56. The method as recited in claim 55, wherein the apparent inlet velocity of said one or more gas compression ramps is at least Mach 2.5.

57. The method as recited in claim 55, wherein the inlet velocity of said one or more gas compression ramps is between Mach 2.5 and Mach 4.

58. The method as recited in claim 55, wherein the apparent inlet velocity of said gas compression ramps is approximately Mach 3.5.

59. The method as recited in claim 55, wherein said gas is selected from the group consisting of (a) air, (b) steam, (c) refrigerant, and (d) hydrocarbons.

60. The method as recited in claim 55, wherein said gas is essentially natural gas.

61. The method as recited in claim 55, wherein said gas is air.

62. The method as recited in claim 55, wherein said gas comprises a refrigerant.

63. The method as recited in claim 55, wherein said gas comprises steam.

64. The method as recited in claim 55, further comprising the step of minimizing aerodynamic drag by minimizing the number of leading edge surfaces subjected to stagnation pressure.

65. The method as recited in claim 64, wherein the number of leading edge surfaces subjected to stagnation pressure is less than five.

66. The method as recited in claim 64, wherein the number of leading edge surfaces subjected to stagnation pressure is four.

67. The method as recited in claim 55, wherein each of said one or more gas compression ramps are circumferentially spaced equally apart so as to engage said supplied gas stream substantially free of turbulence from the previous passage through a given circumferential location of any one said one or more gas compression ramps.

68. The method as recited in claim 55, wherein the cross sectional areas of each of the one or more gas compression ramps are sized and shaped to provide a desired compression ratio.

69. The method as set forth in claim 68, wherein the helical strokes are offset at a preselected angle delta, and wherein the angle of offset matches the angle of offset of each one of said one or more gas compression ramps, and wherein said angles match to allow gas entering the one or more gas compression ramps to be at approximately the same angle as the angle of offset, to minimize inlet losses.

* * * * *

UNITED STATES PATENT AND TRADEMARK OFFICE

CERTIFICATE OF CORRECTION

PATENT NO. : 7,293,955 B2
APPLICATION NO. : 11/087336
DATED : November 13, 2007
INVENTOR(S) : Shawn P. Lawlor, Mark A. Novaresi and Charles C. Cornelius It is certified that error appears in the above-identified patent and that said Letters Patent is hereby corrected as shown below:

IN THE SPECIFICATION:

Column 1, line 29, after the word "applicant", insert --has--.

Column 6, line 32, after the word "height", delete [HS1] and substitute therefore --$HS_1$--.

Column 7, line 24, after the word "stream", delete [P] and substitute therefore --IP--.

Column 9, line 30, after the word "Each", delete [on] and substitute therefore --one--.

IN THE CLAIMS:

Column 11, line 3, delete [features] and substitute therefore --feature--.

Column 12, line 43, after the words "claim 22,", delete [where in] and substitute therefore --wherein--.

Column 13, line 62, after the word "compression", delete [ramp] and substitute therefore --ramps--.

Column 14, line 57, after the words "claim 42,", delete [where in] and substitute therefore --wherein--.

UNITED STATES PATENT AND TRADEMARK OFFICE

CERTIFICATE OF CORRECTION

PATENT NO. : 7,293,955 B2
APPLICATION NO. : 11/087336
DATED : November 13, 2007
INVENTOR(S) : Shawn P. Lawlor, Mark A. Novaresi and Charles C. Cornelius It is certified that error appears in the above-identified patent and that said Letters Patent is hereby corrected as shown below:

Column 16, line 45, after the word "helical", delete [strokes] and substitute therefore --strakes--.

Signed and Sealed this

Fifteenth Day of April, 2008

JON W. DUDAS
*Director of the United States Patent and Trademark Office*